US005644293A

United States Patent [19]

Right et al.

[11] Patent Number: 5,644,293

[45] Date of Patent: Jul. 1, 1997

[54] GROUND FAULT DETECTION WITH LOCATION IDENTIFICATION

[75] Inventors: Robert W. Right, Huntington, Conn.; Jan A. Braam; John P. Hewlin, both of Bradenton, Fla.; Rick A. Wolf, Sarasota, Fla.

[73] Assignee: General Signal Corporation, Stamford, Conn.

[21] Appl. No.: 441,811

[22] Filed: May 16, 1995

[51] Int. Cl.[6] ..... G08B 29/00

[52] U.S. Cl. ..... 340/507; 340/650

[58] Field of Search ..... 340/505, 506, 340/507, 825.54, 825.16, 650, 649; 324/500, 509, 510, 512

[56] References Cited

U.S. PATENT DOCUMENTS

| | | | |
|---|---|---|---|
| 4,901,316 | 2/1990 | Igarashi et al. | 371/37.1 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |

*Primary Examiner*—Jeffery Hofsass
*Assistant Examiner*—Mohammed R. Ghannan
*Attorney, Agent, or Firm*—Ohlandt, Greeley, Ruggiero & Perle

[57] ABSTRACT

A ground fault detection scheme uniquely incorporated within a distributed intelligence, fire alarm and detection system, such that detection is achieved with location identification. The modules (and transponders) of the system collaborate with the loop controller in performing ground fault operations to determine precise existing ground conditions at the module locations.

6 Claims, 13 Drawing Sheets

GROUND FAULT DETECTION WITH LOCATION IDENTIFICATION

The invention of this application is related to inventions described in four other applications with reference to the same fire alarm and detection system: docket 100.0600 "Field Programmable Module Personalities", docket 100.0602 "Line Monitor For Two Wire Data Transmission", docket 100.0603 "Stand Alone Mode For Alarm-Type Module", and docket 100.0604 "Load Shed Scheme For Two Wire Data Transmission".

The present invention relates to a microprocessor-control universal module, and other modules, that are used within a fire alarm and detection system for the detection and indication of fire-related emergency conditions. Generally, a fire alarm and detection system comprises a fire alarm loop controller that extends control to a loop of devices, such as to input/output transponders and fire/smoke detectors, and the like, the universal module of the present invention being one example of such device. More particularly, the present invention relates to a ground fault detection feature for detecting ground faults within the transponder units or modules within the system.

BACKGROUND AND OBJECTS OF THE INVENTION

The present invention is in the field of fire alarm and detection. Early examples of prior systems of this general type may be appreciated by reference to following U.S. Pat. Nos. 4,568,919, 4,752,698, 4,850,018, 4,954,809, 4,962, 368.

Most of the above cited U.S. patents describe systems that are approximately six to ten years old, and in most of these systems the loop controller, or the like, initiates the determination of the states of the units at the various zones or stations in the system by the use of a repetitive polling scheme for polling the detector units or stations from the loop controller, whereby addresses are sent successively on the loop or lines to determine which, if any, units are in an alarmstate. Provision is also made in most of these systems to detect trouble conditions in the system.

Other fire detector and alarmsystems have been developed in the recent past, that is, in the past five years or so, that provide a variety of features, including the feature of an intelligent transponder, combined with an integral processor such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; twisted or shielded wire is not required.

Whatever the advantages and benefits of prior art systems, they fundamentally lack an efficient means or arrangement for providing chassis ground fault detection. Although systems have been known in which ground fault detection schemes have been provided, such schemes have not possessed the ability to identify at the control panel the specific location of a field wiring ground fault, thereby to expedite the repair of a ground fault condition.

Accordingly, it is a primary object of the present invention to provide a low cost method or technique that gives specific location identification of a ground fault condition. By specific location, what is meant is that the control panel immediately knows which transponder unit is experiencing a ground fault so that such fault can be remedied in a short time.

SUMMARY OF THE INVENTION

Before launching into the summary of the invention, it is well to consider certain definitions:

a module when referred to hereinafter is an electronic circuit that is interconnected over the same wire pair as, for example, smoke detectors. Thus, in the system which forms the context of the present invention modules have been incorporated in each of the transponder units located at various zones or stations of the system, and these modules are connected over the same wire pair as the smoke detectors or other sensing devices at the given unit or station. Smoke detectors monitor particles of combustion while the modules themselves monitor external contact closure activity in connection with the outbreak of fire or the like, the closure activity resulting from the response of smoke detectors, and also such as the following: heat detectors, fire alarm pull stations, door closures, fan shutdown, etc.

The ground fault detection feature of the present invention, which enables precise identification of the ground fault location, utilizes a simple scheme in connection with each line-device, i.e., each module; and combines therewith a broadcast command from the controller. In addition, an impedance is intentionally placed on ground in synchronization with the broadcast command, such that this scheme allows each module or line device to determine the loop presence of a ground fault condition.

Briefly stated then the present invention presides in a system comprising an alarmsystem for detecting and warning of the presence of various alarm conditions by means of transponder units located in the plurality of zones, comprising a loop controller having a plurality of supply lines extending to said transponder units; a module, within each of said transponders and connected to said plurality of supply lines, said module being capable of initiating communication of the conditions in its respective zones to said loop controller; a plurality of devices having respective circuits coupled to said module; and means for identifying a particular location of a field wiring ground fault within a given transponder at the control panel so as to expedite the repair of a ground fault condition.

Other and further objects, advantages and features of the present invention will be understood by reference to the following specification in conjunction with the annexed drawings, wherein like parts have been given like numbers.

DESCRIPTION OF PREFERRED EMBODIMENTS

System and Common Module Circuitry

Figure 1:
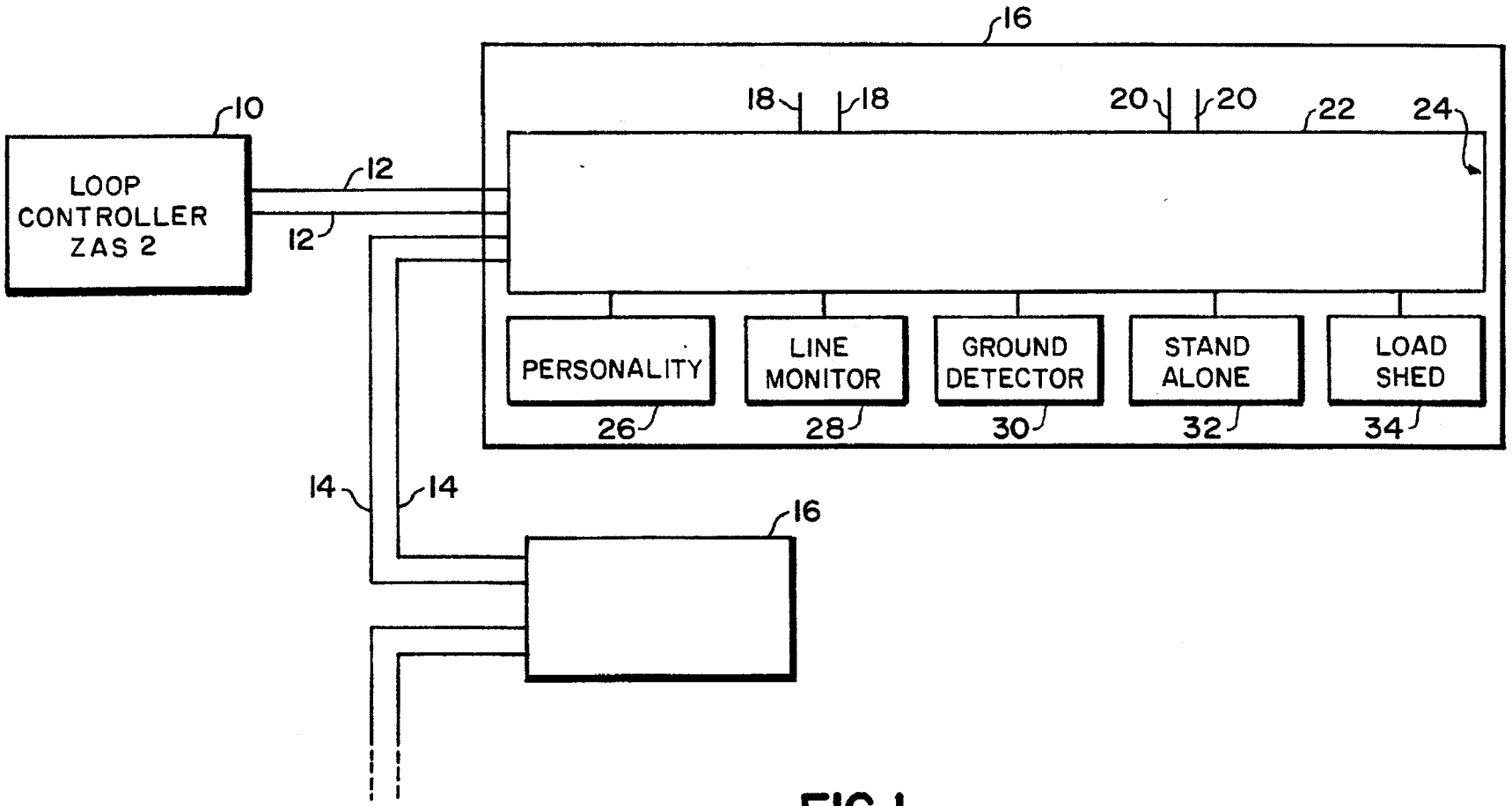
FIG. 1 is a functional block diagram which provides an simplified overview of the system in which the present invention is incorporated to constitute a unique group of transponder modules in such system.

Referring now to FIGS. 1–4 and more particularly for the moment to FIG. 1 of the drawing, there will be seen a simplified showing of the system context in which the present invention operates in order accurately to monitor and measure slave circuit impedance changes by incorporating a line voltage monitoring mechanism to be described.

In FIG. 1, the loop controller 10 is connected by multiple-wire outgoing and return cable 12 to a first transponder unit 16 which, in turn, is connected by a multiple-wire cable 14 to the next unit 16 and so on to other units.

Within the uppermost unit 16, there are seen a block designated 22 representing common components of a transponder module 24 whose inputs/outputs are represented by pairs of lines 18 and 20, which are supplied, typically with 24 v DC, and can be variously connected by the module to provide different modes of operation for the transponder 16. Also seen connected to the lower part of the common components 22 of the module 24 are the several inventive features forming parts of the module circuitry: a "personality" feature 26 which involves selective programming of a microcontroller, which forms the centerpiece of the module 24, such that various prescribed functions can be realized by the given module depending on the configuration code chosen. This personality feature is described and claimed in co-pending application, docket 100.0600 which is incorporated herein by reference.

The line monitor feature is described and claimed in docket 100.0602. The stand alone feature 32 is described and claimed in docket 100.0603 and the load shedding feature 34 is described and claimed in docket 100.0604; the details of all of the preceding features being incorporated herein by reference to their respective patent applications already noted.

Figure 2:
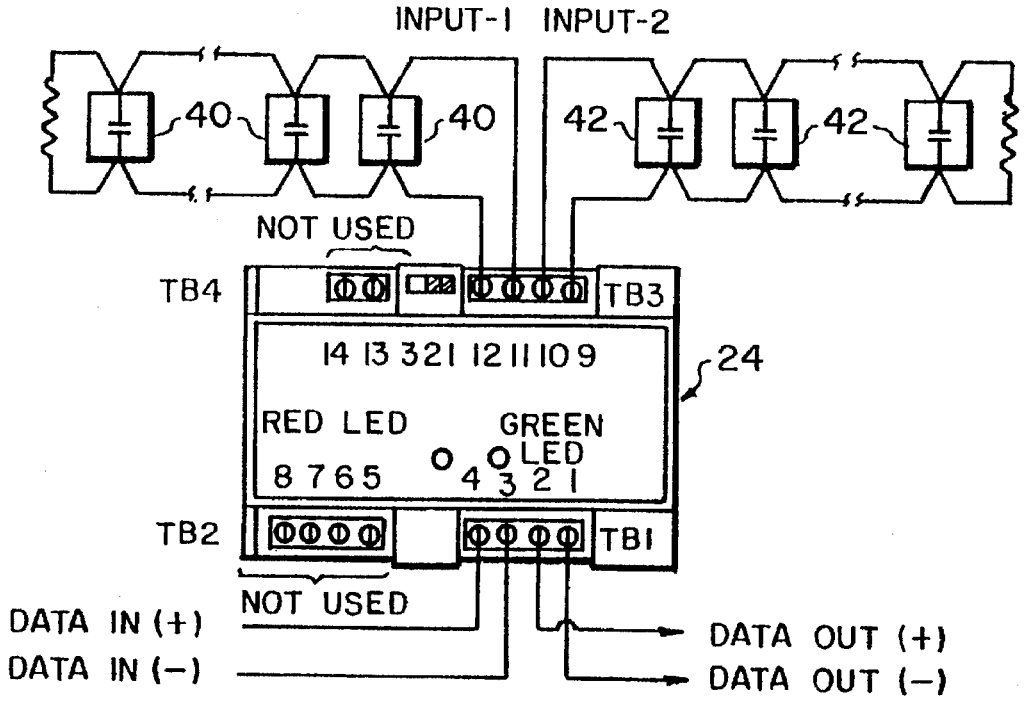
FIG. 2 is a block-schematic diagram of a class B dual input arrangement for a universal class A/B module incorporating the present invention.

Referring now to FIG. 2 of the drawing, there is depicted the module 24 which is a universal module and can be arranged, in this example, to operate class B, as a dual input module. Moreover, in this figure, connections of "data in" lines and "data out" lines are seen made to terminal blocks at the bottom of the modules, these lines corresponding, respectively, to lines 12 and 14 in FIG. 1. However, not seen in FIG. 1 are the particular class B input connections of FIG. 2, which are effectuated by the switch contacts 40, representing typical initiating devices, in input circuit 1 and, similarly, the contacts 42 in input circuit 2.

If a particular personality code, for example, personality code 1 is assigned to both of the input circuits seen in FIG. 2, this configures either one or the other or both circuits for class B normally open, involving dry contact initiating devices such as pull stations, heat detectors, etc. Consequently, when an input contact is closed an alarmsignal is sent to the loop controller and the alarm condition is latched at the module 24. Further, it will be understood, particularly by reference to co-pending applications, docket 100.0600, that other personality codes assigned to the input circuits will provide different operations for water flow alarmswitches, fans, dampers, doors, as well as other switches.

Figure 3:
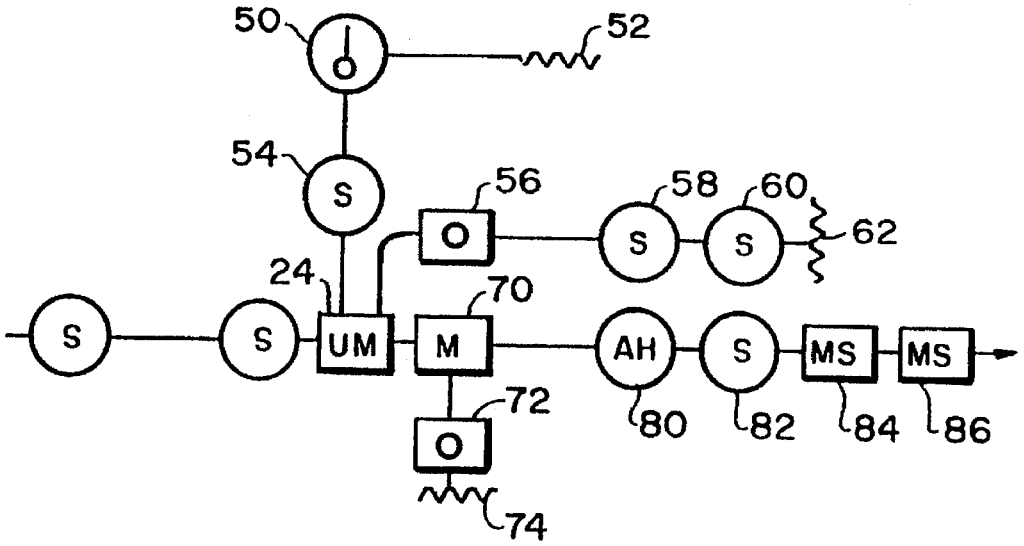
FIG. 3 is a block diagram of part of a system, and particularly illustrating a variety of devices in the form of smoke detectors and other devices connected to a universal transponder module at a given zone or station.
Figure 4A:
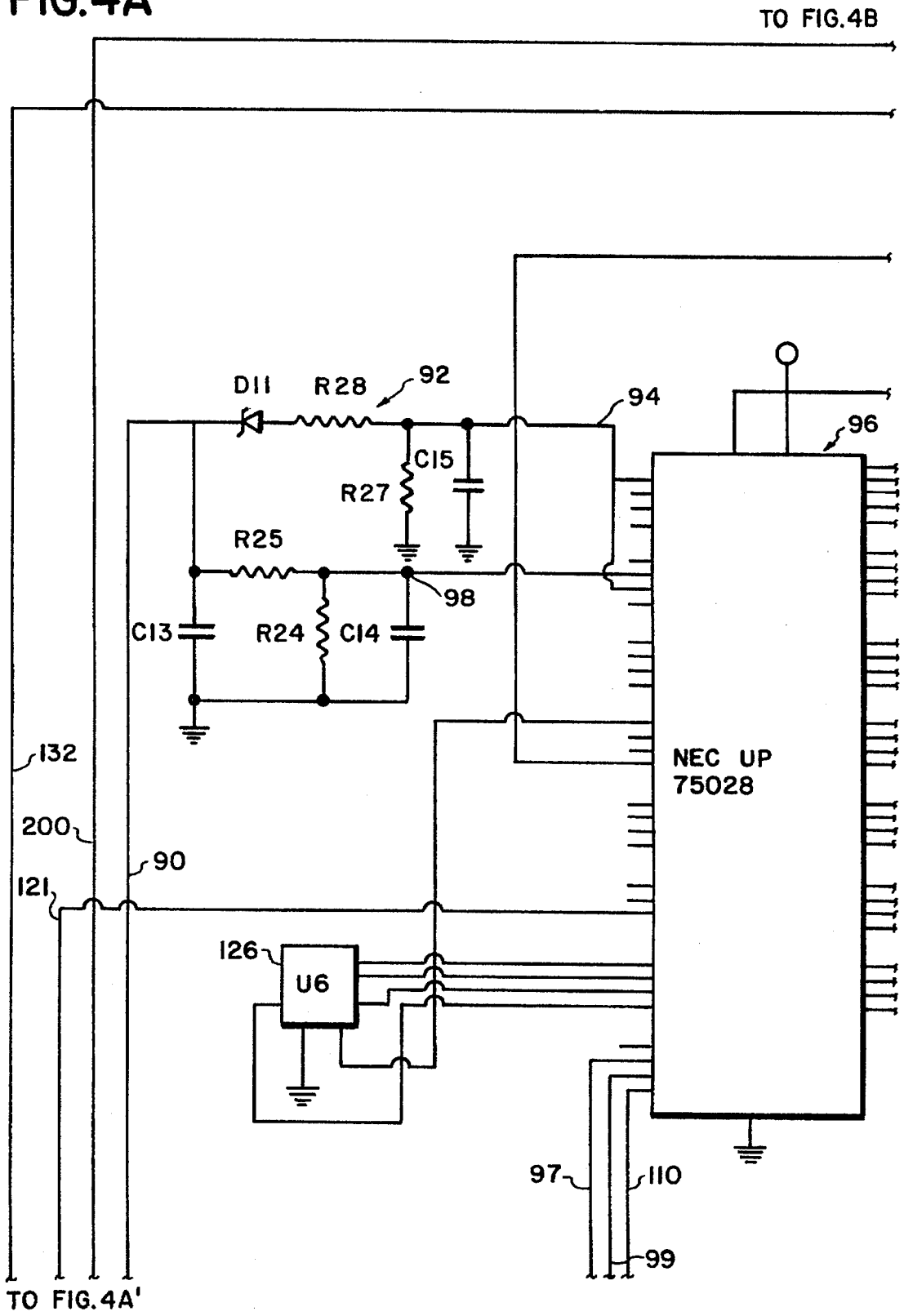
FIG. 4 is a schematic diagram of a transponder, including a module.
Figure 4B:
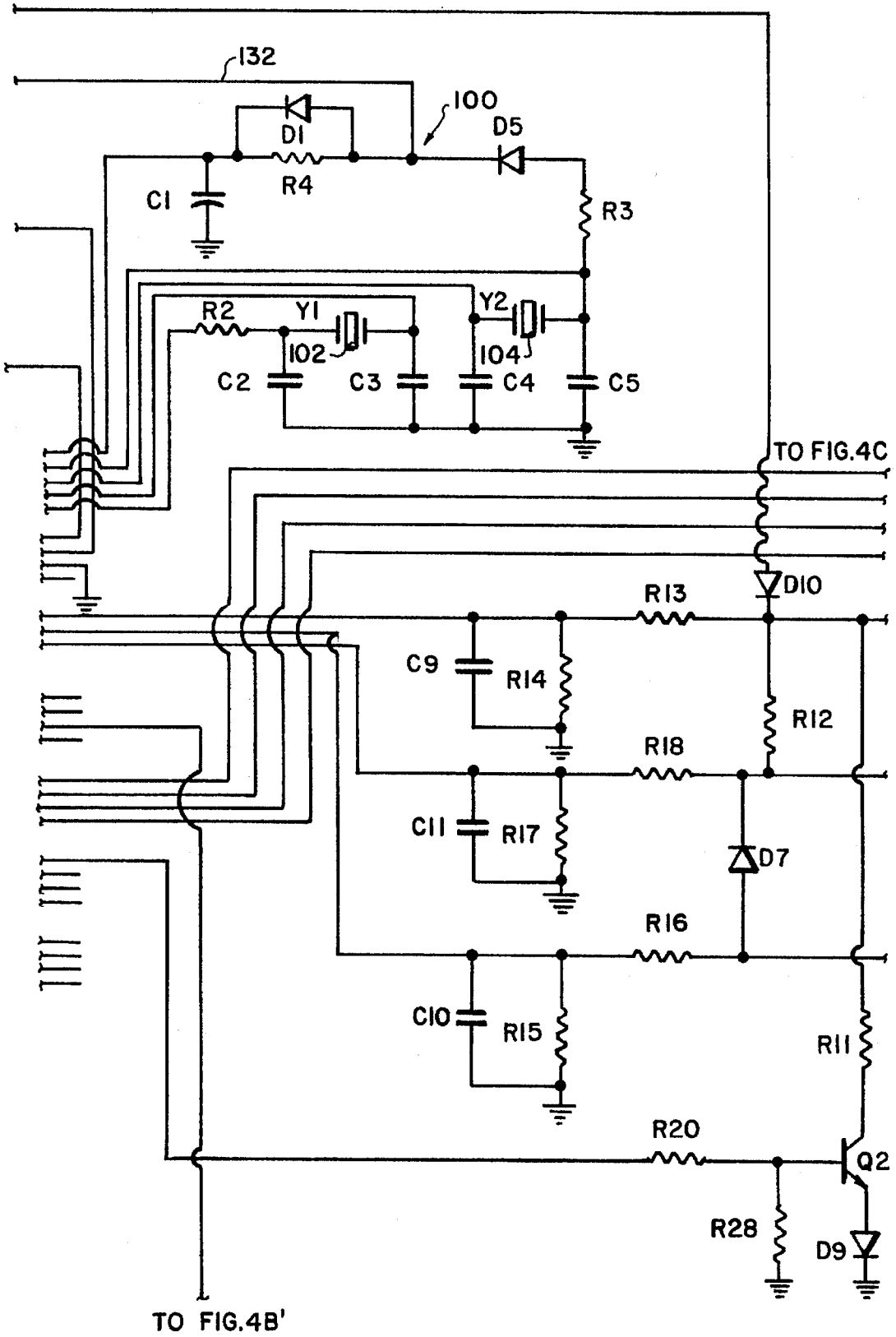
Figure 4C:
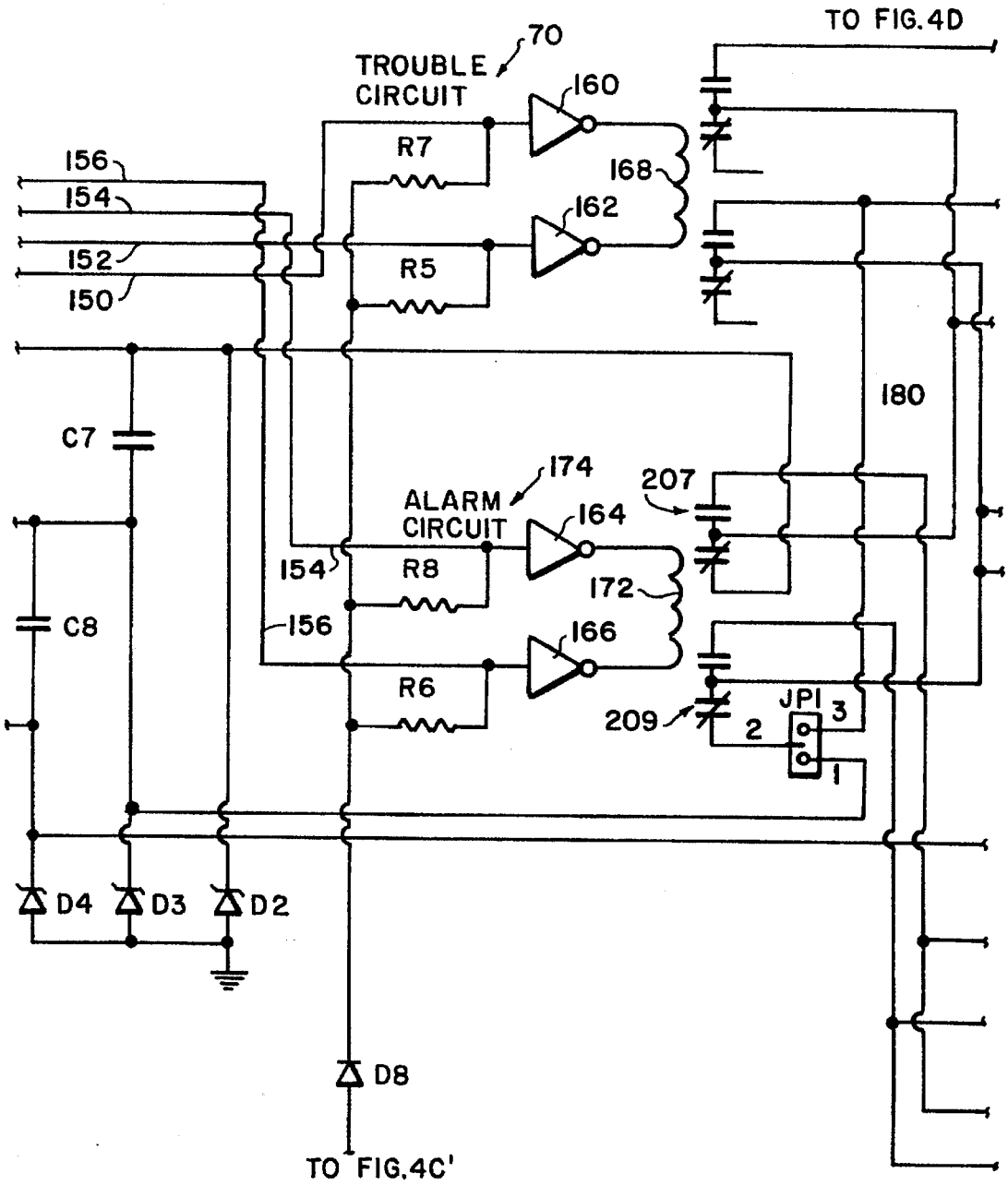
Figure 4D:
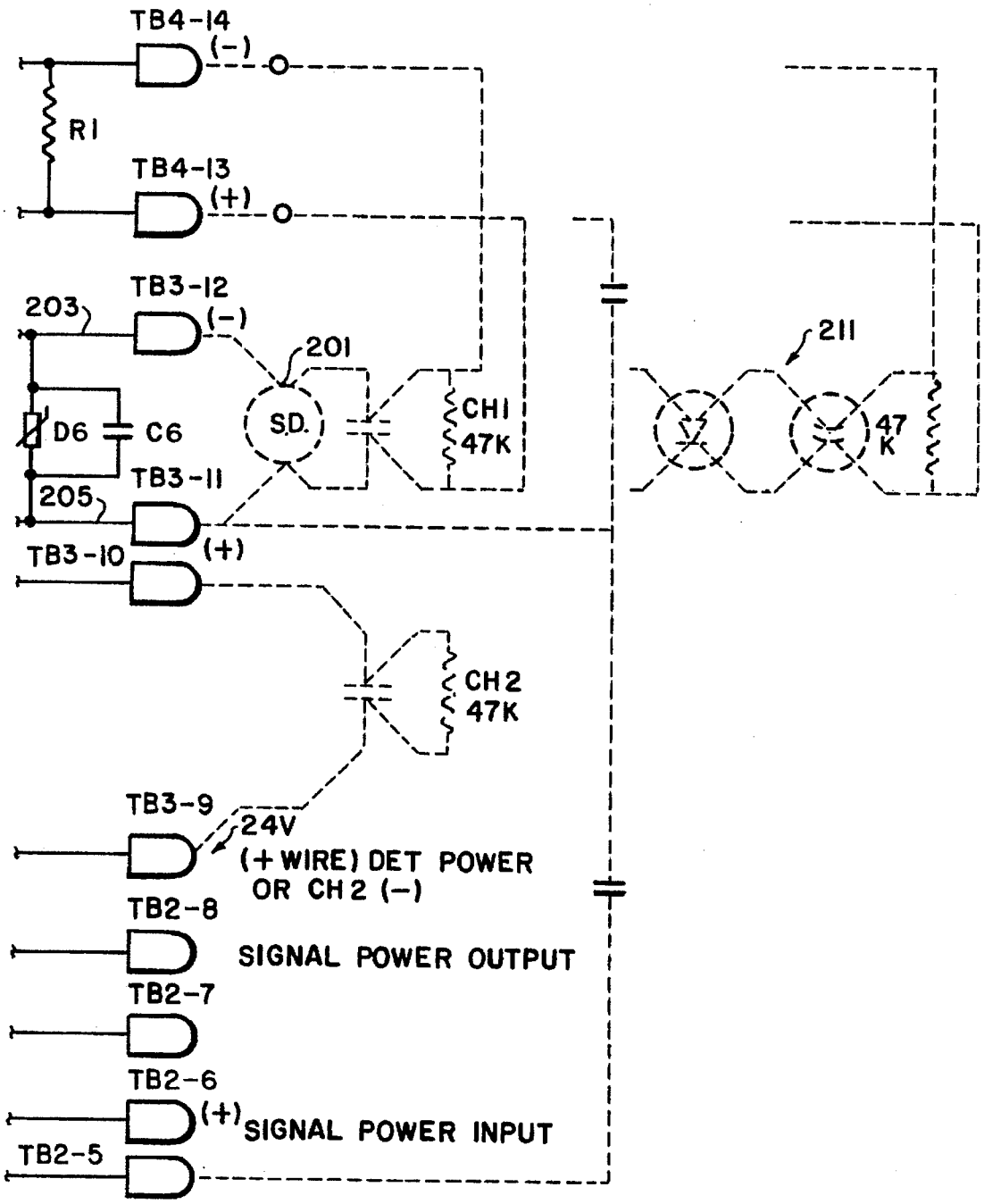
Figure 4A:
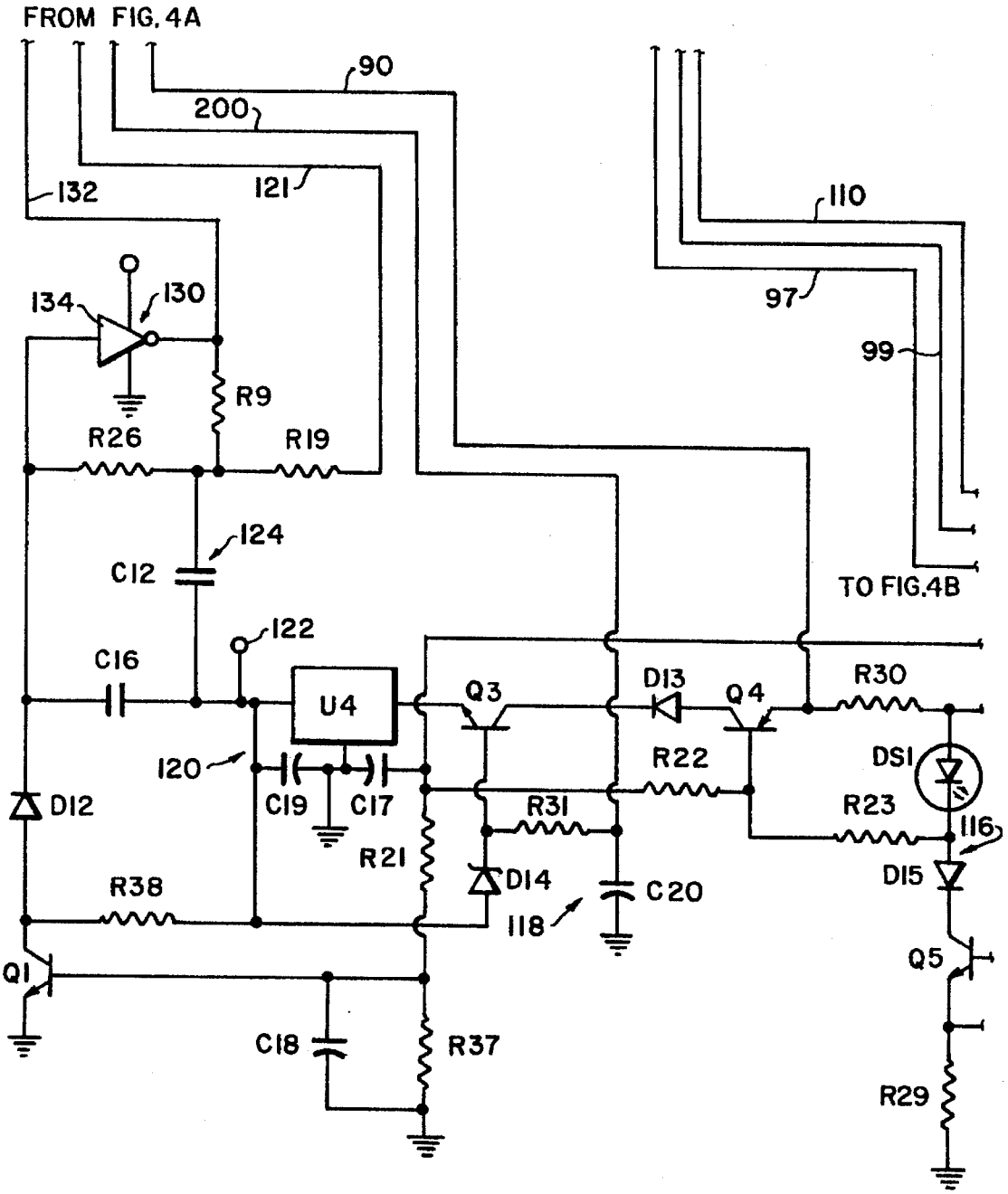
Figure 4B:
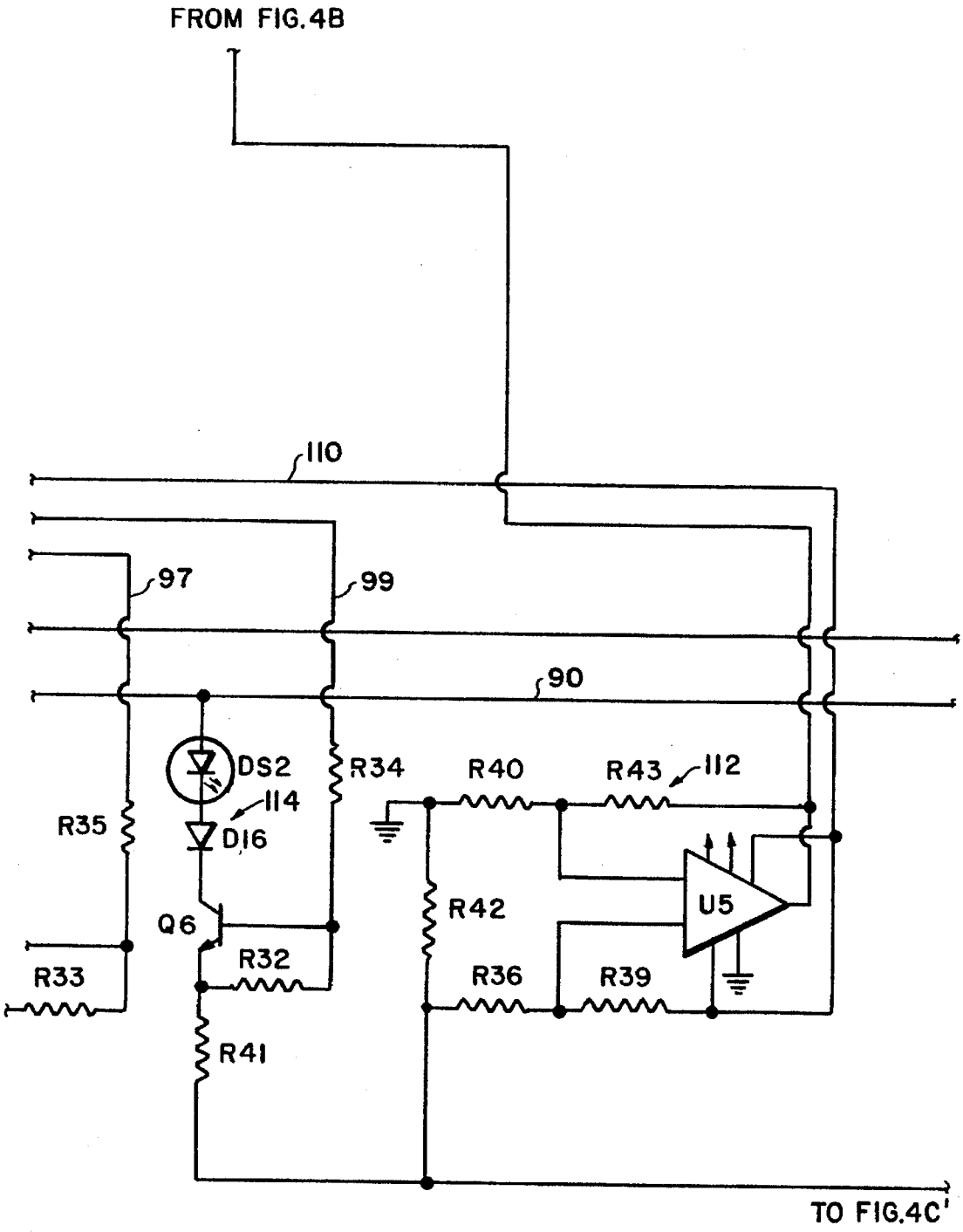
Figure 4C:
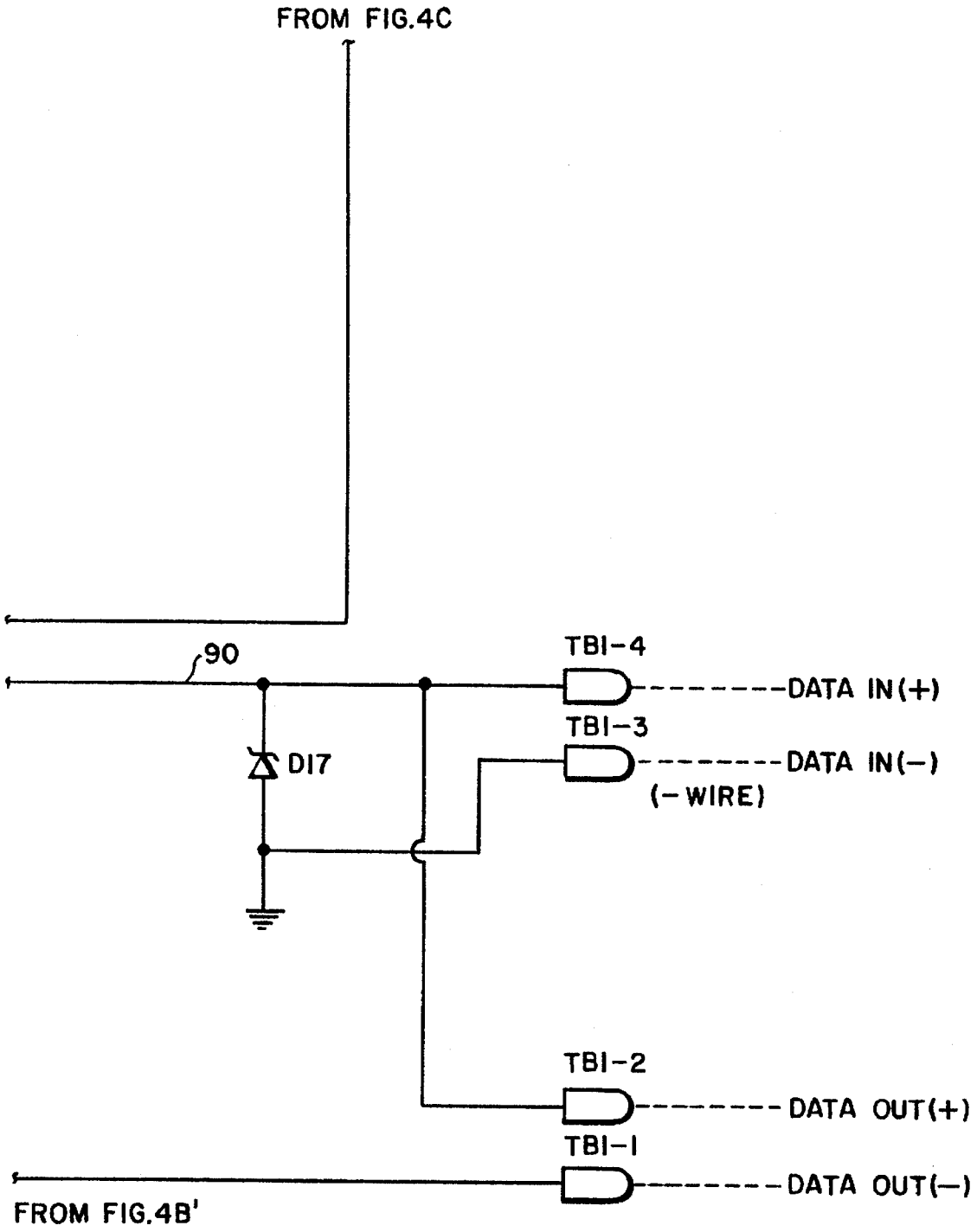
Figure 5:
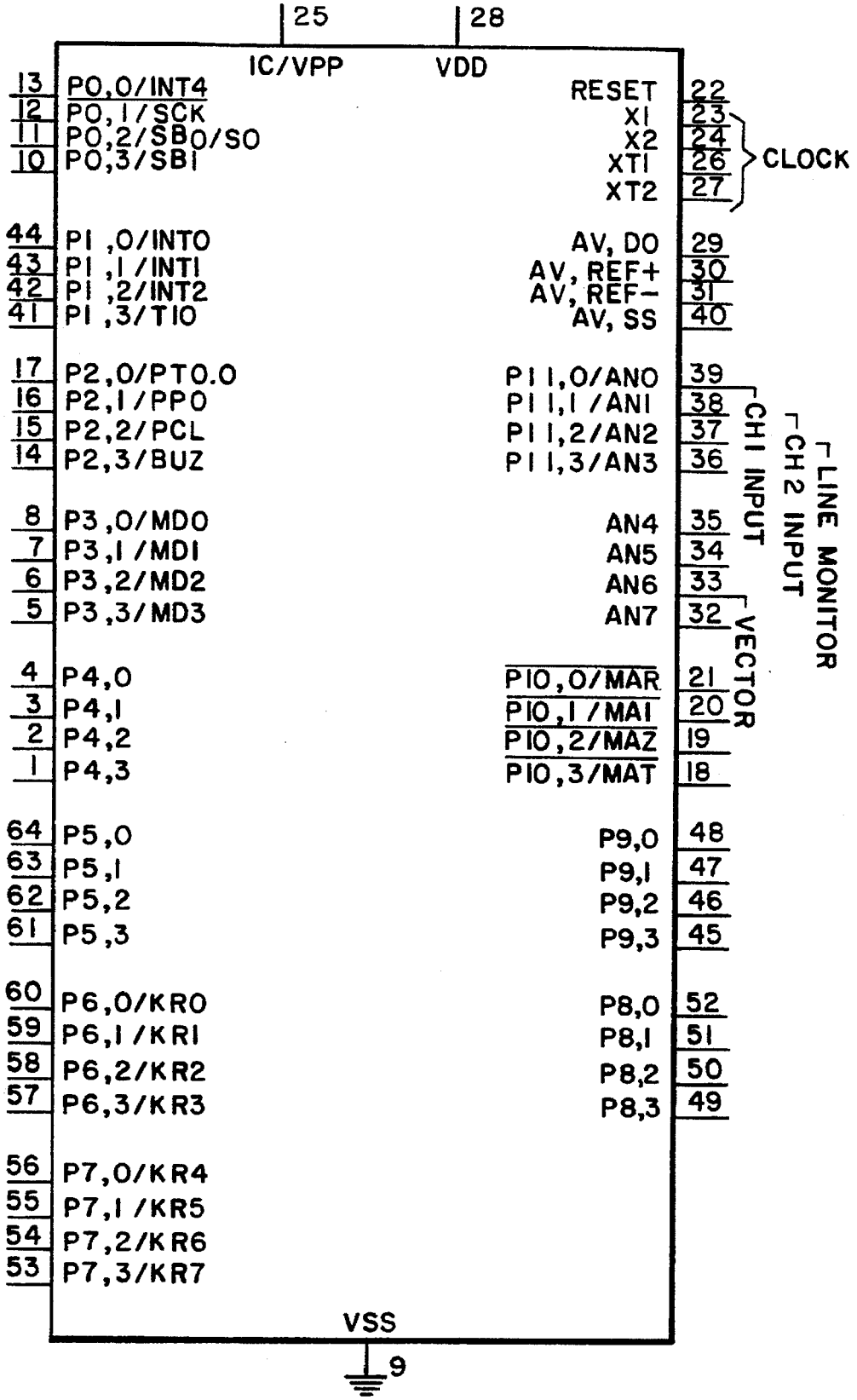
FIG. 5 is a magnified view of the microcontroller of the universal module of FIG. 4A.

FIG. 3 illustrates the system where focus is on the selected circuitry or circuitry pathways extending from the universal module 24, as previously discussed, is a part of a transponder unit 16 located at a given zone or station. The module 24 which is depicted in association with a variety of devices in, for example, input circuits. Such devices can be selected as a package with such universal module 24, or the module can be incorporated into an already existing system, that is, retrofitted to an older style system to bring it up-to-date to-date. Thus, as shown in FIG. 3, two loops extend from the upper portion of the module. One loop includes a heat detector 50, an end of line resistor 52 and a conventional smoke detector 54. In the other loop there is a manual station 56, and two conventional smoke detectors 58, 60 with an end of line resistor 62 for that other loop.

Also connected to the universal module 24, in yet another loop, is a plurality of intelligent devices, including a monitor module 70 and associated therewith a manual station 72, and an end of loop resistor 74. Also extending, in a further loop, from the afore-noted monitor module 70 is an intelligent analog heat detector 80, an intelligent analog smoke detector 82, and analog manual stations 84 and 86.

FIGS. 4A through 4D and 4A' through 4C' are combined to form a schematic diagram of the module 24 in which the line/monitor feature is embodied. To be considered first are the common aspects of such module 24. The module circuitry has at the lower fight in FIG. 4C the connection from the loop controller to the "data in" lines 12 at the terminals designated TB 1-4, TB 1-3; as well as the connection to the next transponder unit at another location (see at the very bottom of the figure) by way of the "data out" lines 14 from terminals TB 1-2, TB 1-1.

It will be appreciated that data communication is accomplished over the aforesaid lines, as well as synchronous, large signal, transmission. As one example, interrupt (command) signals from the loop controller are transmitted to the module 24 over the "data in" lines (designated 12 in FIG. 1 ), three levels of interrupt command voltages being available; that is, zero volts, 9 volts, or 19 volts can be transmitted from loop controller 10.

The loop controller sends messages out by changing the line voltage between 0, 9, and 19 volts. The devices respond by drawing 9 ma of current during specific time periods. The basic time period of the protocol is given by:

$$T=\frac{64}{32768}=1.953\text{ msec.}$$

The loop controller uses a basic time period of ½T(0.976 ms) because it has to sample the loop voltage and current in the middle of the data bits.

Figure 6:
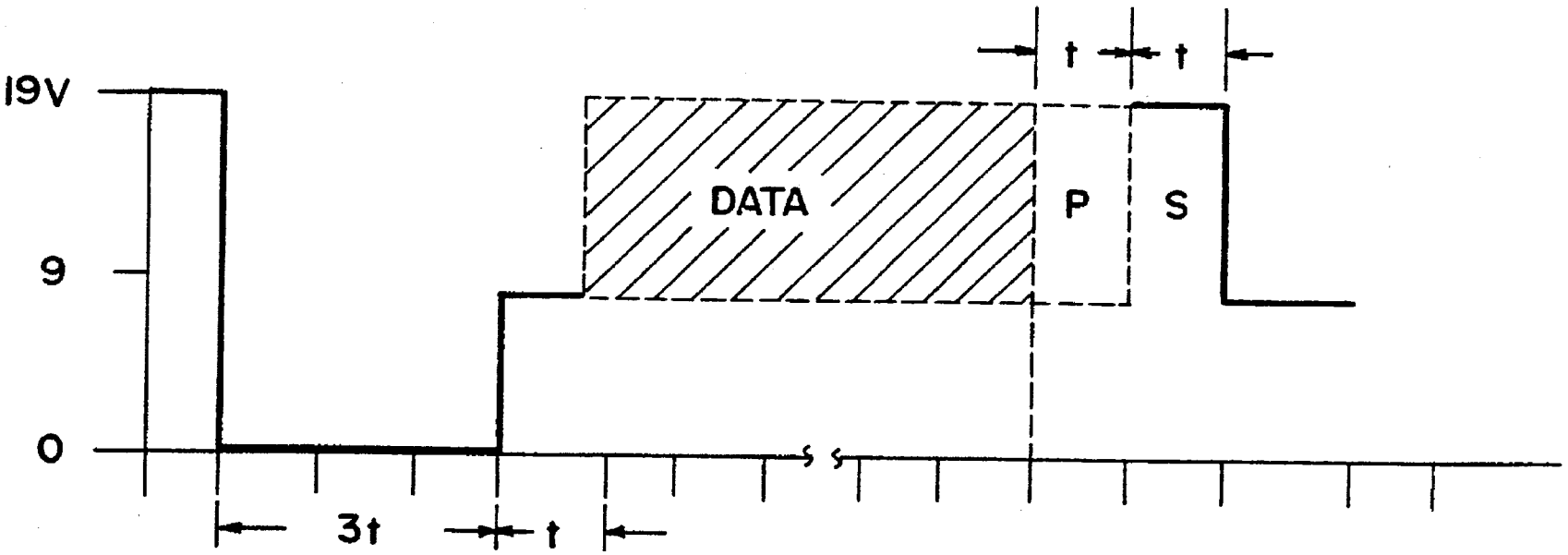
FIG. 6 is a timing diagram illustrating the application of inputs to the data lines from the loop controller.

The start-up message, or interrupt mechanism, is specific and recognized by the module as follows: (Also, see FIG. 6).

1. The line voltage (across data lines 12) is initially at 19 volts for at least 2 time periods.
2. The line is held at 0 volts for 3 time periods.
3. The line goes to 9 volts for a 1 time period—this is the wake-up or interrupt bit and modules synchronize on this edge.
4. The line alternates between 9 and 19 volts for n T periods, where n is the number of data bits in the message.
5. The parity bit (even) follows the data bits.
6. The stop bit puts the line at 19 volts for 2 T periods, then the next message may be sent.

The voltages noted above are transmitted by way of internal connection 90 to a discriminator circuit 92 at the upper left in FIG. 4, whose output is connected from the uppermost node 94 of circuit 92, via inputs 13 and 42 to input ports of microcontroller 96. The discriminator circuit 92 also includes another output, taken at node 98, to a terminal 43 of the microcontroller. This microcontroller is selected to have an NEC microprocessor therein, as well as an EE PROM 126 manufactured by Excel.

As will be appreciated, the discriminator circuit insures that when 19 volts is received from the loop controller, such value is sufficient to exceed the upper threshold set by the circuit and hence inputs 13 and 42 are active, whereas when only 9 v appear, only input 42 is active.

It should be noted that the centerpiece or control device for the module 24 is the microcontroller 96. A number of input/output ports (PO.O, etc.) to which connecting terminals are provided, are shown on each side of the microcontroller, as well as connections made to the top and bottom thereof. It will be noted that a ground connection is made at the bottom of the microcontroller (Vss) and a bias connection (3.3 volts) at the top terminals 25 and 28, as well as a connection from terminal 25 to terminal 29 on the fight side of the microcontroller.

A group of terminals 22–27 are provided for reset and for timing control of the microcontroller, the timing control connection being made to a timing circuit 100, provided with two clocks 102 and 104.

Another group of terminals are used for reference and average bias manual connections, such being designated terminals 30, 31 and 40, the 3.3 volt bias, terminal 30 to an input/output port at terminal 5; and terminals 31 and 40 to ground.

Groups of analog/digital ports are connected to the terminals designated 33, 37–39 of the microcontroller, the first being a vector input from circuit 112; the last three—being monitoring terminals, as will be explained hereafter.

A further group of terminals 18–21 are connected to input/output ports of microcontroller 96, which are, in turn, connected to relay cards for purposes to be explained. Another terminal on the fight of the microcontroller is terminal 48, connected to "load shed" line 101 for purposes to be explained in connection with a load shed feature in accordance with a related invention.

Other groups of terminals, connected with output ports, appear on the left of the microcontroller. The group 53–55 is shown connected to circuitry at the lower portion of FIG. 4 and which will be explained. These output ports provide communication back to the main or control panel, terminal 53 being connected by the connecting means 110 to the output of circuit 112 at the bottom of the figure and, hence, terminal 53 connects to an input port of the microcontroller; whereas 54 and 55 connect to the respective circuits 114 and 116 which are LED circuits, that is, circuits for illuminating LED's at appropriate times. Further portions of the circuitry involve a peak detector 118 and a bias circuit 120 which, as can be seen, has the node 122 and supplies the bias of 3.3 volts for the microcontroller 96. A watchdog circuit 124 is seen immediately above the bias circuit 120, having a connection 121 to the microcontroller at terminal 62. Another group of four input/output ports is connected by respective terminals 57 through 60 to terminals of a 64 bit register 126. It will be seen that a connection from terminal 8 of the microcontroller is made to terminal 8 of register 126 for the purpose of providing a "strobe" to the register 126 in order to read the unit's identifying number stored in such register.

A reset circuit 130 furnishes a Reset +signal by way of the connection 132 to the clock circuit 100, the amplifier 133 in such circuit being biased from the 3.3 volts supply provided at node 122.

It will be noted that output terminals 18–21 of microcontroller 96 extend, by means of respective connections 150, 152, 154, and 156, to respective operational amplifiers, 160, 162, 164, and 166. The former two, that is, 160 and 162 are connected to respective ends of coil 168 and a trouble circuit 170 (which can be operated in class A, if desired), whereas, the operational amplifiers 164 and 166 are connected to opposite ends of relay coil 172, thus defining an alarm circuit 174.

Each of the relays in the trouble and alarm circuits is a double-pole, double throw, each involving four relay contacts, two being shown open and two being shown closed in each circuit.

The smoke detector 201 is seen connected across terminals TB 3-11 and TB 3-12; thence, by connecting means 203 and 205 to the respective points between pairs of alarm relay contacts 207 and 209. Alternative devices, such as bell or speaker 211 are similarly connected when called for—being accomplished—by selecting appropriate states for the relay contacts 203,205, 207 & 209.

It will be understood that the specific type of device, i.e., bell, telephone, heat detector, manual pull station, etc., that is selectively connected to the module is dependent on the assigned personality, or set of configuration bits, that is sent to the modules memory at the time of installation (and which set can be suitably changed at a later time, as already explained). For example, if the personality that is sent to the module is "2-wire smoke detector", then non-intelligent conventional-type 2-wire smoke detectors would be connected to terminals 11 and 12. Conversely, if the personality desired was to operate bells during alarm condition, the personality "Class B or Class A Signal Output" would be assigned and bells would be connected to terminals 11 and 12, and no 2-wire smoke detectors would be allowed on this module. Likewise, other selected personalities for the module would dictate other modes of operation for that portion of the circuitry in which the devices are selectively connected.

The Ground Fault Detection Feature

Figure 7:
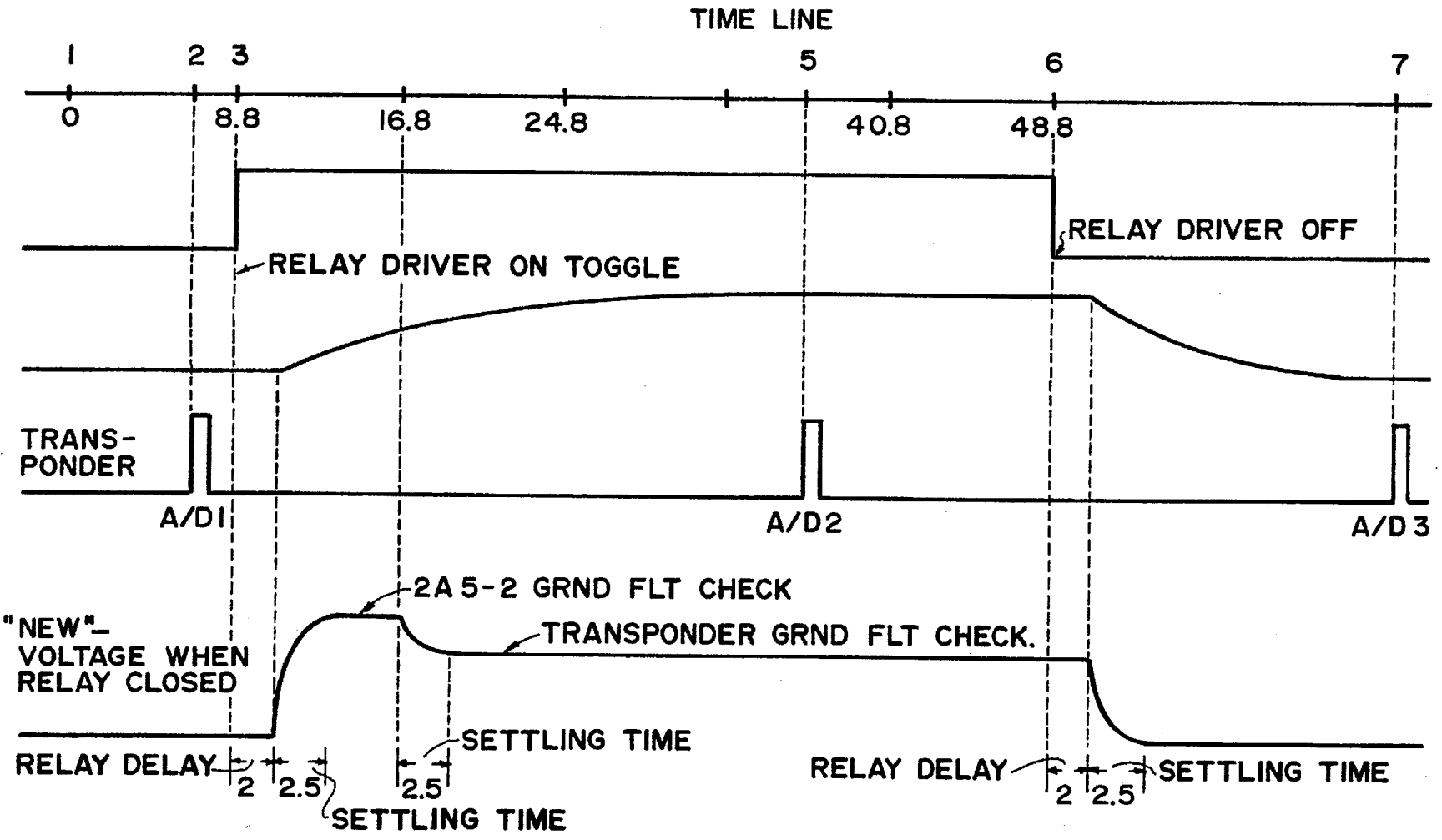
FIG. 7 is a time line which particularly indicates the activation of a relay at certain prescribed times as part of the ground fault detection feature of the present invention.
Figure 8:
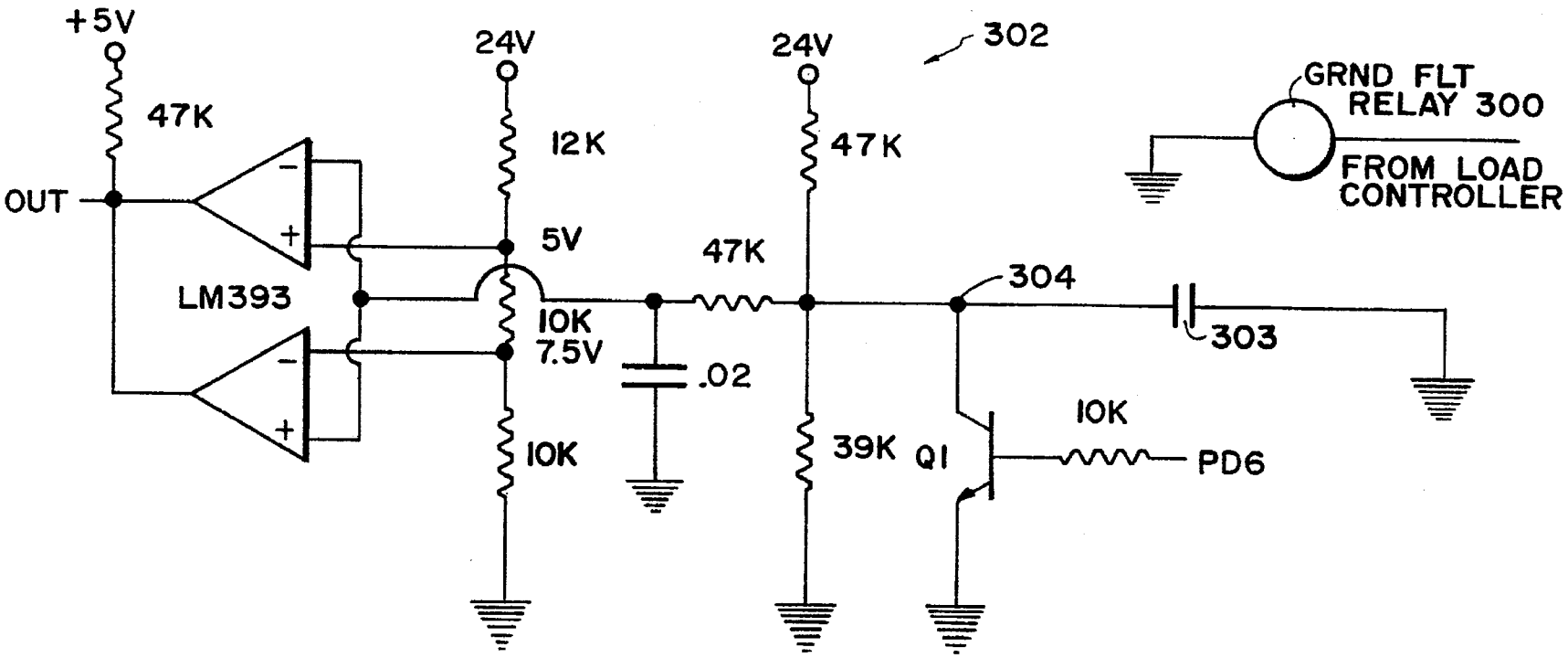
FIG. 8 is a driver circuit for driving the relay operative in the ground fault checking step.

The ground fault detection feature may be understood by particular reference to FIGS. 7 and 8 of the Drawing. In particular, FIG. 8 includes a relay circuit, such relay being operative in the process for detecting a ground fault, its operation being initiated at the loop controller 10, also referred to as ZAS-2, in FIG. 1. The time line showing in FIG. 7 is useful in explaining the relay operation and other operations over a given time period.

Accordingly, it will be understood that the controller ZAS-2 sends a command to the modules to anticipate a ground fault check, this being indicated on the time line at the upper portion marked "1". Responsive to the command from the ZAS-2 controller, the modules at time "2" do a first A/D sample 6.75 ms after initial command. Seen at time "3", controller ZAS-2 closes the ground fault relay 300 shown in FIG. 8.

It will be appreciated the relay 300 is circuit driven and activated by the loop controller at a prescribed time. When the relay is energized, the normally open contacts 303 close, connecting earth, or chassis ground to the ground fault voltage monitor input 304.

It should be noted that the relay driver signal is shown as having an increased level at the time designated "3", that is, at 8.8 ms.

It should be noted that the ground detection circuit described below operates in two bias modes.

Bias Mode 1:

The first bias mode operates at 10.8 vdc with ground fault windows set at 15 and 7.5 v. In this mode, ground faults, or in other words, inadvertent connections of field wires to building, earth, chassis, or conduit ground will be detected when voltages on these wires are in excess of 15v or less than 7.5v. These voltages will be detected immediately by the loop controller prior to time designated "4" in FIG. 7. This is accomplished by checking the comparator output of operational amplifiers LM393 (FIG. 7).

Bias Mode 2:

In this mode, the bias point is set to 5v rather than 10.8v. This represents a lower impedance and is required by the module to accurately detect ground faults on its respective wiring. This occurs at the time designated "4" in FIG. 7 by turning on transistor Q1 so that the modules can perform their ground fault operation.

At time "15" is the second A/D sample at 30 ms after the first A/D sample. (See the 4th time line from the top, marked "transponder" showing A/D#1, A/D#2 and A/D #3). Incidentally, the 3rd and 5th time line show the voltage values over the course of time, taking into account the settling time and relay delay and the like. At time "6" (48.8 ms) the controllers ZAS-2 opens the ground fault relay 300 and at time "7" the modules do the 3rd or A/D#3 sample, which is 29 ms after the second A/D sample.

It should be noted that the delays mentioned are done in sub-clock mode to reduce current consumption. Also, the delay may be made varied by approximately plus or minus 3 ms using a value in one of the registers set aside for this purpose in EE prom 126. It will be understood that the total time from the start of the command (19 to zero volt interrupt) to the end of the A/D#3signal or pulse is approximately 100 ms. The A/D values read during the ground fault check operation just described are processed during the next main cycle of module software. The module can now decide if a ground-fault has occurred on its slave-circuit field-wiring by comparing the three A/D measurements just taken.

An example of this would be if the values were normal before the ground fault test command was sent out, the module would be in the normal state. When the command is received by the module alerting the module, thereby the ground fault relay is about to activate and place a bias voltage on the chassis ground. The module immediately takes the first A/D reading and stores the results, takes a second reading while the ground fault relay is activated and stores the results, and a third A/D reading after the ground fault relay is set back to inactive, and stores the results.

Now the module can determine if a ground fault exists. If the value was normal, went abnormal during ground fault test, and then went back to normal after the ground fault test, then a ground fault must have existed and is processed. In other words, slave circuit voltages are measured by the module during the ground fault test mode, but readings before and after must also be considered.

Another example, if the value was normal, went abnormal during ground fault test, and remained abnormal after the ground fault test, then the module had an alarm or trouble condition occur during the ground fault test, and ground fault would not be processed. Additional processing would resume and a state determination would eventually be made.

Another noteworthy item is that the influence of a ground fault on the slave circuit wiring that might otherwise cause an alarm or trouble condition is masked out because the module stops normal processing prior to the bias being connected to earth ground. Therefore, ground faults to slave circuit will not cause undesirable operation. (It is important to detect a ground fault so as to provide early indication so if a second fault occurs it does not cause a false alarm or trouble).

The processing of the A/D values consists of two separate operations. The first operation compares the line A/D values collected during A/D "1" and A/D "2". This is done only if the personality bits for the device sub-type indicate that the line monitor A/D input is part of normal processing.

A ground fault condition in set if the A/D#2 value is less than A/D#1 by an amount greater than or equal to the threshold in EE register 21 low Byte. The following actions are taken:

If a ground fault trouble is not already set for channel 1, the following status bits are updated: set channel status bit; clear channel status bit; set channel and common new status bits; set specific trouble bit.

If a ground fault condition is not detected on the line monitor side of the external wiring, the A/D values on the channel A/D inputs are processed as the second part of the ground fault operation. For the channel A/D values this is a two part process. First, the A/D#2 value is compared to A/D#1. If it is less than by an amount greater than or equal to the threshold in EE register 21 high byte, the second part of the process is required. Here, the A/D#3 value is compared to the AD#1 value to determine if an actual open circuit occurred during the ground fault check operation.

If the A/D#3 value is less than the A/D#1 value by amount greater than or equal to the threshold in EE register 22 low byte, then an open circuit occurred. Thus, the difference in the A/D#2 and A/D#1 values are not considered to be a detected ground fault. The following processing is done if a ground fault is not detected:

If the channel has its ground fault trouble bit set, the trouble bit is cleared and the status and new status bits are updated, depending on the state of other trouble bits.

If the A/D#3 value and A/D#1 value comparison do not indicate an open circuit condition, the difference in the A/D#2 and A/D#1 values are treated as a ground fault condition. The following processing is done if a ground fault is detected: set channel status bit; clear channel status bit; set channel and common new status bits; set specific trouble bit.

It will be appreciated from the description of the present invention, i.e., the ground fault detection feature or scheme uniquely incorporated within a distributed intelligence, fire alarm and detection system, that detection is achieved with location identification. The modules (and transponders) of the system collaborate with the loop controller in performing ground fault operations to determine precise existing ground conditions at the module locations.

The invention having been thus described with particular reference to the preferred forms thereof, it will be obvious that various changes and modifications may be made therein without departing from the spirit and scope of the invention as defined in the appended claims.

We claim:

1. An alarm system for detecting and warning of the presence of various alarm conditions at transponder units located in a plurality of respective zones, comprising:

a loop controller having a control panel and plurality of supply lines extending to said transponder units;

a module, within each of said transponders, connected to said plurality of supply lines, said module being capable of initiating communication of the conditions in its respective zone to said loop controller;

a plurality of circuits coupled to said module, said circuits including devices connected by field wiring; and, first means for detecting a ground fault, including means for identifying at the control panel a particular location of a field wiring ground fault within a given transponder so as to expedite the repair of a ground fault condition.

2. An alarm system as defined in claim 1, in which each module includes second means for detecting a ground fault.

3. An alarm system as defined in claim 2, further comprising means for transmitting a broadcast command from the controller; and means for connecting the first means for detecting a ground fault to chassis ground and in synchronization with said broadcast command, whereby each module determines the presence of a ground fault condition within its respective transponder unit.

4. An alarm system as defined in claim 3, further comprising a switching circuit at the loop controller for closing contacts to ground at predetermined times.

5. An alarm system as defined in claim 4, in which said means for detecting a ground fault, includes a relay circuit having comparators for furnishing an output voltage in excess of 15 v or less than 7.5 v.

6. An alarm system as defined in claim 1, further comprising means for storing successive A/D readings in said modules as a measure of whether a ground fault exists.

* * * * *